US007385351B2

(12) United States Patent
Ahn

(10) Patent No.: US 7,385,351 B2
(45) Date of Patent: Jun. 10, 2008

(54) PLASMA DISPLAY PANEL HAVING A SEALING LAYER AND METHOD OF FABRICATING THE SAME

(75) Inventor: Young Joon Ahn, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/637,773

(22) Filed: Dec. 13, 2006

(65) Prior Publication Data

US 2007/0085480 A1 Apr. 19, 2007

Related U.S. Application Data

(63) Continuation of application No. 10/830,068, filed on Apr. 23, 2004.

(30) Foreign Application Priority Data

Apr. 25, 2003 (KR) ..... 10-2003-26401

(51) Int. Cl.
*H01J 17/49* (2006.01)

(52) U.S. Cl. ..... 313/582; 313/584; 313/587; 313/292

(58) Field of Classification Search ..... 313/582, 313/584, 586, 587, 292
See application file for complete search history.

(56) References Cited

U.S. PATENT DOCUMENTS

| | | | | |
|---|---|---|---|---|
| 3,849,190 | A * | 11/1974 | Foster et al. | 313/587 |
| 4,320,418 | A * | 3/1982 | Pavliscak | 348/797 |
| 5,336,121 | A | 8/1994 | Baret | 445/25 |
| 5,972,564 | A | 10/1999 | Kawana et al. | 430/281.1 |
| 6,097,149 | A | 8/2000 | Miyaji et al. | 313/528 |
| 6,218,777 | B1 | 4/2001 | Jones et al. | 313/495 |
| 6,242,859 | B1 * | 6/2001 | Betsui et al. | 313/584 |
| 6,261,144 | B1 | 7/2001 | Nishiki et al. | 445/24 |
| 6,414,434 | B1 | 7/2002 | Nakano et al. | 313/582 |
| 6,495,262 | B2 | 12/2002 | Igeta | 428/426 |
| 6,514,111 | B2 | 2/2003 | Ebihara et al. | 445/25 |
| 6,605,834 | B1 | 8/2003 | Lee | 257/295 |
| 6,614,412 | B1 | 9/2003 | Hirano et al. | 345/60 |
| 6,761,608 | B2 | 7/2004 | Tanaka | 445/25 |
| 6,774,562 | B2 | 8/2004 | Roche et al. | 313/582 |
| 6,827,623 | B2 | 12/2004 | Nakatake et al. | 445/25 |
| 6,833,672 | B2 * | 12/2004 | Aoki et al. | 313/582 |
| 2002/0036466 | A1 | 3/2002 | Tanaka et al. | 313/566 |
| 2003/0102803 | A1 | 6/2003 | Chang | 313/112 |
| 2005/0029938 | A1 | 2/2005 | Kwon et al. | 313/582 |
| 2006/0119265 | A1 | 6/2006 | Cho | 313/582 |

FOREIGN PATENT DOCUMENTS

| | | | |
|---|---|---|---|
| JP | 2001166284 A | * | 6/2001 |
| KR | 102000011255 | | 2/2000 |
| KR | 1020010056987 | | 7/2001 |

* cited by examiner

*Primary Examiner*—Joseph L. Williams
*Assistant Examiner*—Kevin Quarterman
(74) *Attorney, Agent, or Firm*—KED & Associates, LLP

(57) ABSTRACT

There is disclosed a plasma display panel that is adaptive for improving yield and mass productivity and a fabricating method thereof. A plasma display panel according to an embodiment of the present invention includes a first substrate; a second substrate facing the first substrate with a discharge space therebetween; a sealing layer located between the first substrate and the second substrate; and a buffer layer formed between the first substrate and the sealing layer to compensate the thermal stress of the first substrate and the sealing layer.

25 Claims, 23 Drawing Sheets

PLASMA DISPLAY PANEL HAVING A SEALING LAYER AND METHOD OF FABRICATING THE SAME

This application is a Continuation Application of U.S. patent application Ser. No. 10/830,068, filed Apr. 23, 2004, which claims the benefit of the Korean Patent Application No. P2003-26401 filed in Korea on Apr. 25, 2003, the subject matters of which are hereby incorporated by reference.

BACKGROUND OF THE INVENTION

1. Field of the Invention

The present invention relates to a plasma display panel, and more particularly to a plasma display panel that is adaptive for improving yield and mass productivity and a fabricating method thereof.

2. Description of the Related Art

A plasma display panel (hereinafter 'PDP') has light emission of phosphorus caused by ultraviolet rays of 147 nm that is generated upon discharge of inert mixed gas such as He+Xe, Ne+Xe, He+Xe+Ne, thereby displaying a picture including characters or graphics. Such a PDP is easy to be made into a thin-film and large-dimension type of it. Moreover, the PDP provides a very improved picture quality owing to recent technical development.

Referring to FIG. 1, a discharge cell oaf three-electrode AC surface discharge type PDP includes a sustain electrode pair 4 formed on an upper substrate 16 and an address electrode 2 formed on a lower substrate 14.

Each of the sustain electrode pair 4 includes a transparent electrode 4A of indium tin oxide ITO and a metal bus electrode 4B formed at one side of the edge of the transparent electrode 4A. An upper dielectric layer 12 and a protective film 10 are deposited on the upper substrate 16 where the sustain electrode pair 4 has been formed. Wall charges generated upon plasma discharge are accumulated in the upper dielectric layer 12. The protective film 10 prevents the upper dielectric layer 12 and the sustain electrode pair 4 from being damaged due to sputtering generated upon plasma discharge, and in addition, it increases the emission efficiency of secondary electron. The protective film 10 is normally magnesium oxide MgO.

A lower dielectric layer 18 and barrier ribs 8 are formed on the lower substrate 14 where address electrode 2 has been formed, and a phosphorus 6 is formed on the surface of the lower dielectric layer 18 and the barrier ribs 8. The address electrode 2 is orthogonal to the sustain electrode pair 4. The barrier ribs 8 are formed along the address electrode 2 to prevent the ultraviolet ray and visible ray generated by discharge from leaking out to adjacent discharge cells. The phosphorus 6 is excited by the vacuum ultraviolet ray generated upon plasma discharge to generate any one of red, green or blue visible ray.

Inert mixed gas such as He+Xe, Ne+Xe, He+Xe+Ne is injected for discharge into a discharge space of the discharge cell provided between the upper/lower substrate 16, 14 and the barrier ribs 8.

On the other hand, the lower substrate 14 where the address electrode 2 has been formed is joined with the upper substrate 16 where the sustain electrode pair 4Y, 4Z has been formed, as shown in FIG. 2, by a sealing layer 50.

FIGS. 3A to 3D are sectional diagrams representing a sealing process of PDP of prior art.

Firstly, the sustain electrode pair 4Y, 4Z and the upper dielectric layer 12 are formed on the upper substrate 16, as shown in FIG. 3A.

The sealing layer 50, as shown in FIG. 3B, is formed on the upper substrate 16 where the upper dielectric layer 12 has been formed. The sealing layer 50 is formed by spreading sealing-paste in use of a screen printing or a dispenser, wherein the sealing-paste is formed by mixing glass powder, solvent and binder together.

Subsequently, under the environment of 200~300° C., the protective film 10 is formed on the upper substrate 16 in use of E-beam deposition or sputtering methods, as shown in FIG. 3C.

Subsequently, the upper substrate 16 is aligned with the lower substrate 14 while the upper substrate 16 where the sealing layer 50 has been formed is pressed against and joined with the lower substrate 14. The aligned upper substrate 16 and lower substrate 14 are fired to remove a large amount of solvent and organic material which are contained within the sealing layer 50, thereby joining the upper/lower substrate 16, 14, as shown in FIG. 3D.

However, after the protective film 10 is formed under the environment of 200-300° C., there occurs a crack in the area of the upper substrate 16 contacted with the sealing layer 50 due to the difference of thermal expansion coefficient between the upper substrate 16 and the sealing layer 50 in the course that it cools down to normal temperature. The difference of such thermal expansion coefficients generates partial thermal stress on a part where the upper substrate 16 is in contact with the sealing layer 50. There is generated a thermal stress which is relatively bigger in the upper substrate 16 than in the sealing layer 50, wherein the upper substrate 16 has relatively bigger thermal expansion coefficient than the sealing layer 50, and the thermal stress causes the crack to be generated in the upper substrate 16.

Accordingly, there is a problem that the yield and mass productivity of PDP is decreased.

SUMMARY OF THE INVENTION

Accordingly, it is an object of the present invention to provide a plasma display panel that is adaptive for improving yield and mass productivity and a fabricating method thereof.

In order to achieve these and other objects of the invention, a plasma display panel according to an aspect of the present invention includes a first substrate; a second substrate facing the first substrate with a discharge space therebetween; a sealing layer located between the first substrate and the second substrate; and a buffer layer formed between the first substrate and the sealing layer to compensate the thermal stress of the first substrate and the sealing layer.

The buffer layer is composed of PbO of 45~55%, B2O3 of 10~20%, Al2O3 of 10~20% and SiO2 of 15~25%.

The thermal expansion coefficient of the buffer layer is different from the thermal expansion coefficient of the first substrate.

The thermal expansion coefficient of the buffer layer is the same as the thermal expansion coefficient of the first substrate.

The thermal expansion coefficient of the buffer layer is different from the thermal expansion coefficient of the sealing layer.

The thermal expansion coefficient of the buffer layer is the same as the thermal expansion coefficient of the sealing layer.

The thermal expansion coefficient of the first substrate is around $80\times10^{-7}$~$95\times10^{-7}$/° C.

The thermal expansion coefficient of the sealing layer is around $65\times10^{-7}$~$80\times10^{-7}$/° C.

The thermal expansion coefficient of the buffer layer is around $72\times10^{-7}$~$86\times10^{-7}$/° C.

The plasma display panel further includes a protective film formed on the first substrate where the buffer layer has been formed.

The plasma display panel further includes an upper dielectric layer formed on the first substrate; and a protective film formed on the upper dielectric layer.

The buffer layer is formed to be extended from the upper dielectric layer.

The buffer layer is separately formed of a different material from the upper dielectric layer.

The buffer layer is formed of the same material as the upper dielectric layer.

A fabricating method of a plasma display panel according to another aspect of the present invention includes the steps of: forming a buffer layer on a first substrate; and forming a sealing layer on the buffer layer.

The fabricating method further includes the steps of: providing a second substrate facing the first substrate where the sealing layer has been formed; and joining the first substrate with the second substrate.

The fabricating method further includes the steps of: forming an upper dielectric layer on the first substrate; and forming a protective film on the upper dielectric layer.

In the fabricating method, the buffer layer is composed of PbO of 45~55%, B2O3 of 10~20%, Al2O3 of 10~20% and SiO2 of 15~25%.

In the fabricating method, the thermal expansion coefficient of the buffer layer is different from the thermal expansion coefficient of the first substrate.

In the fabricating method, the thermal expansion coefficient of the buffer layer is the same as the thermal expansion coefficient of the first substrate.

In the fabricating method, the thermal expansion coefficient of the buffer layer is different from the thermal expansion coefficient of the sealing layer.

In the fabricating method, the thermal expansion coefficient of the buffer layer is the same as the thermal expansion coefficient of the sealing layer.

In the fabricating method, the thermal expansion coefficient of the first substrate is around $80\times10^{-7}$~$95\times10^{-7}$/° C.

In the fabricating method, the thermal expansion coefficient of the sealing layer is around $65\times10^{-7}$~$80\times10^{-7}$/° C.

In the fabricating method, the thermal expansion coefficient of the buffer layer is around $72\times10^{-7}$~$86\times10^{-7}$/° C.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

With reference to FIGS. 4 to 12C, embodiments of the present invention will be explained as follows.

Figure 1:
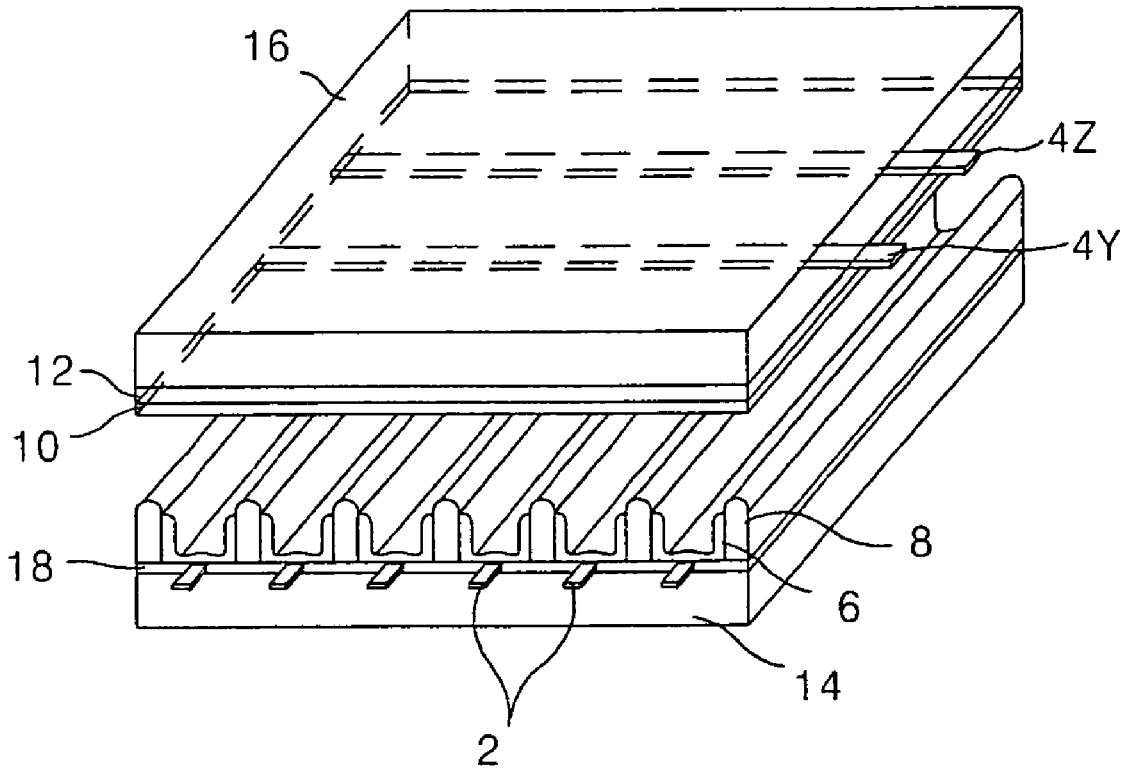
FIG. 1 RELATED ART
FIG. 1 is a perspective view representing a discharge cell structure of a 3-electrode AC type plasma display panel of prior art.
Figure 2:
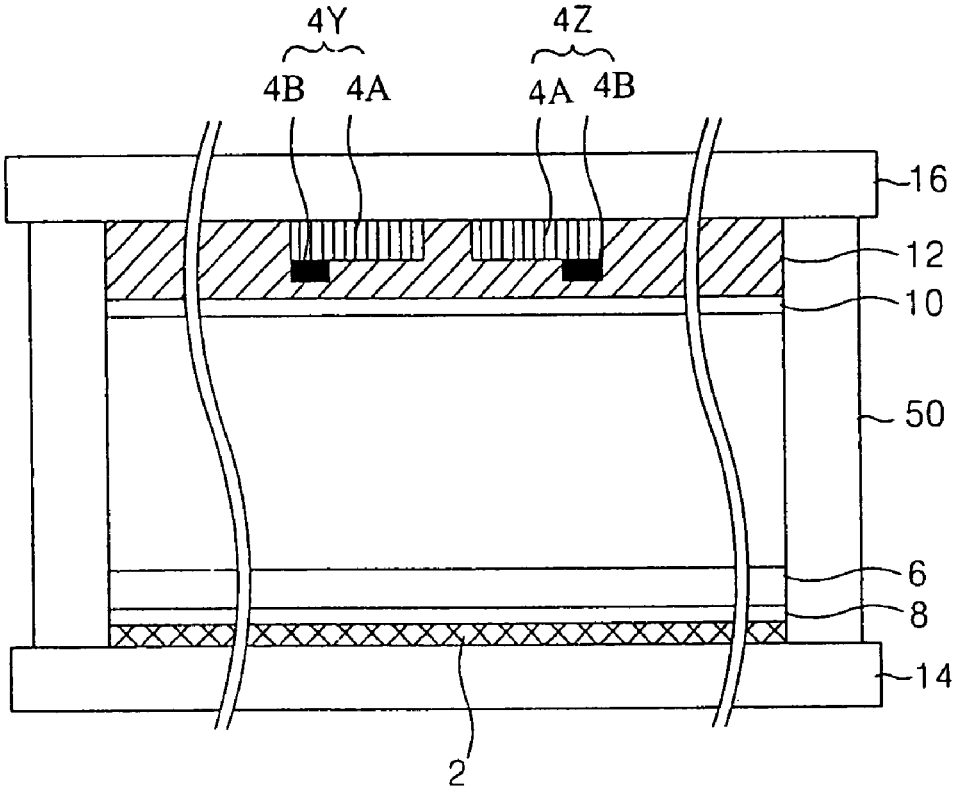
FIG.2 RELATED ART
FIG. 2 is a sectional diagram representing a discharge cell structure of the plasma display panel, as shown in FIG. 1.
Figure 3A:
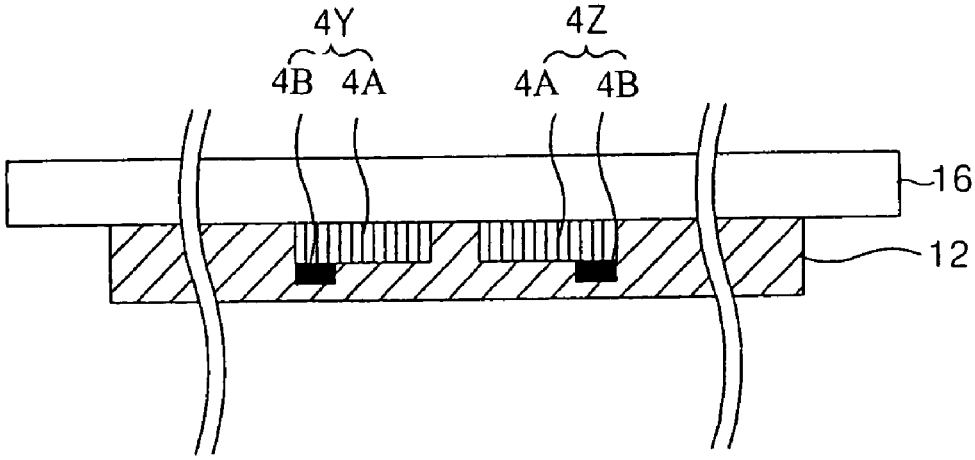
FIG.3A RELATED ART
FIGS. 3A to 3D are sectional diagrams representing a sealing process of the plasma display panel of prior art.
Figure 3B:
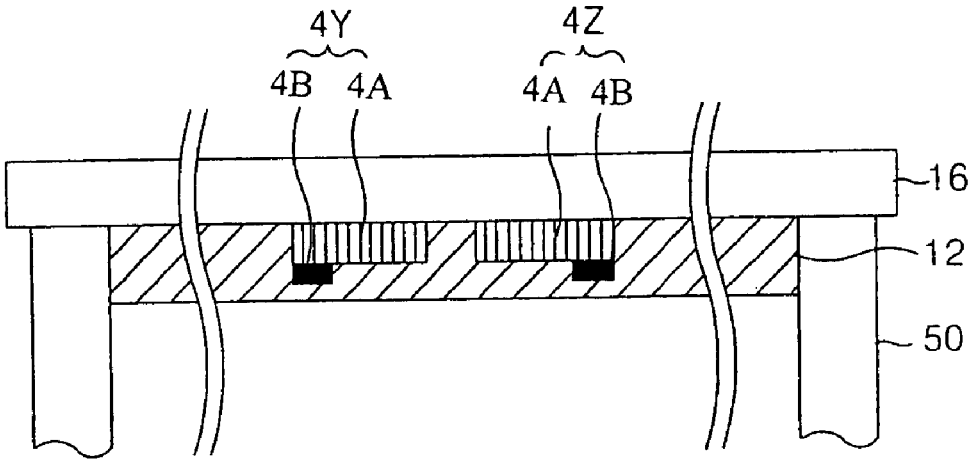
FIG.3B RELATED ART
Figure 3C:
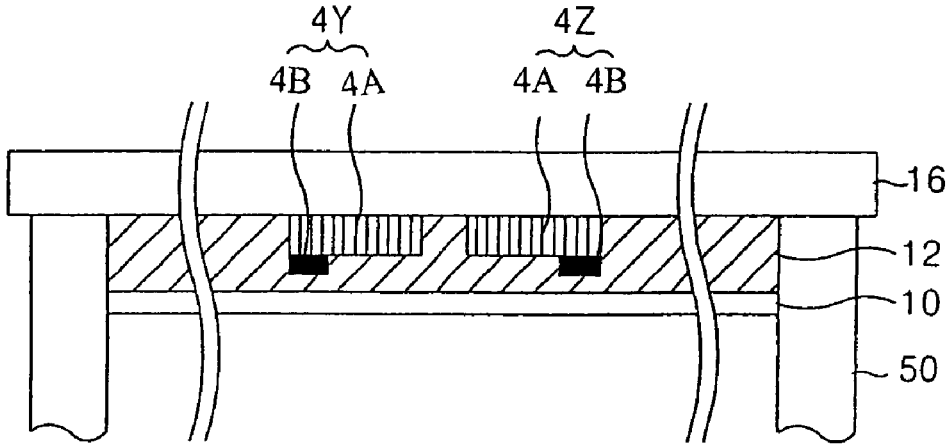
FIG.3C RELATED ART
Figure 3D:
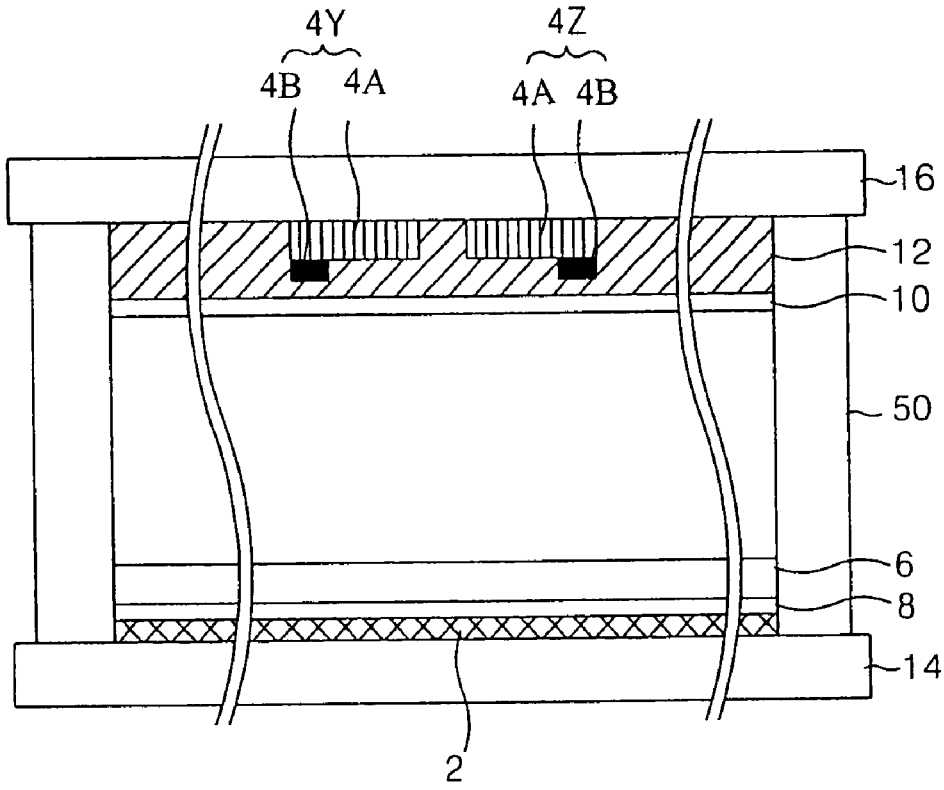
FIG.3D RELATED ART
Figure 4:
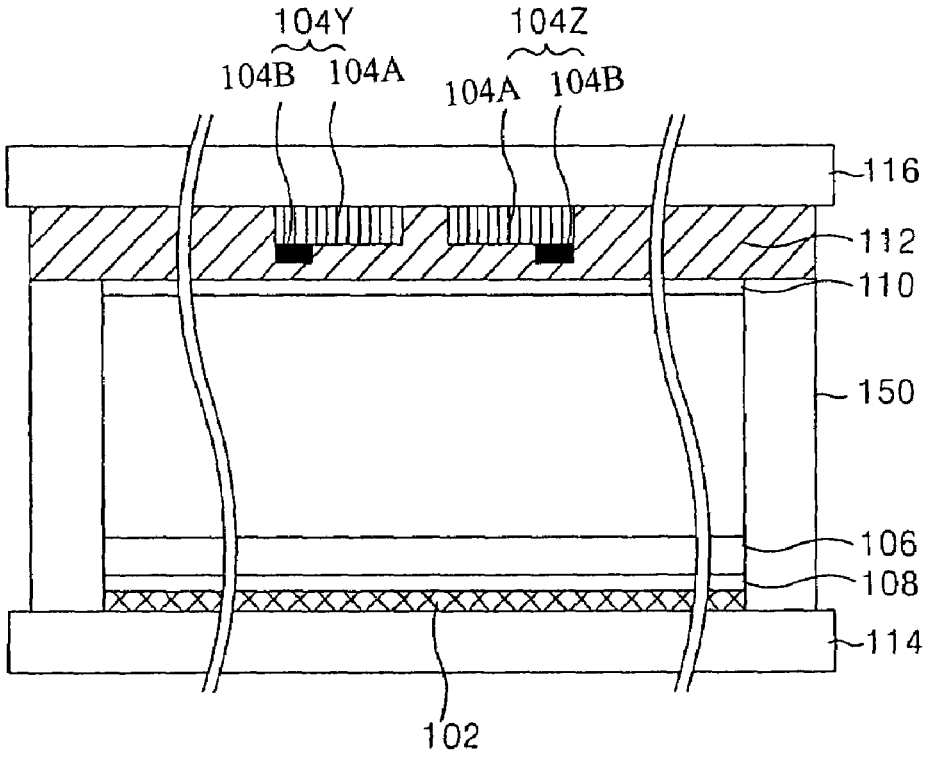
FIG. 4 is a sectional diagram representing a discharge cell structure of a plasma display panel according to a first embodiment of the present invention.

FIG. 4 is a sectional diagram representing a PDP according to a first embodiment of the present invention.

Referring to FIG. 4, a discharge cell of a 3-electrode AC surface discharge type PDP includes a sustain electrode pair 104Y, 104Z formed on an upper substrate 116, and an address electrode 102 formed on a lower substrate 114. Herein, a sealing layer 150 joins the upper substrate 116 with the lower substrate 114.

Each of the sustain electrode pair 104Y, 104Z includes a transparent electrode 104 A of indium tin oxide ITO and a metal bus electrode 104B formed at one side of the edge of the transparent electrode 104A. An upper dielectric layer 112 and a protective film 110 are deposited on the upper substrate 116 where the sustain electrode pair 104Y, 104Z have been formed. The upper dielectric layer 112 is extended to the sealing area of the upper substrate 116, so as to be in contact with the sealing layer. Also, wall charges generated upon plasma discharge are accumulated in the upper dielectric layer 112. The protective film 110 prevents the upper dielectric layer 112 and the sustain electrode pair 104 from being damaged due to sputtering generated upon plasma discharge, and in addition, it increases the emission efficiency of secondary electron. The protective film 110 is normally magnesium oxide MgO.

A lower dielectric layer 118 and barrier ribs 108 are formed on the lower substrate 114 where the address electrode 102 has been formed, and a phosphorus 106 is formed on the surface of the lower dielectric layer 118 and the barrier ribs 108. The address electrode 102 is orthogonal to the sustain electrode pair 104Y, 104Z. The barrier ribs 108 are formed along the address electrode 102 to prevent the ultraviolet ray and visible ray generated by discharge from leaking out to adjacent discharge cells. The phosphorus 106 is excited by the vacuum ultraviolet ray generated upon plasma discharge to generate any one of red, green or blue visible ray.

Inert mixed gas such as He+Xe, Ne+Xe, He+Xe+Ne is injected for discharge into a discharge space of the discharge cell provided between the upper/lower substrate 116, 114 and the barrier ribs 108.

On the other hand, the upper dielectric layer 112 according to the first embodiment of the present invention is formed between the upper substrate 116 and the sealing layer 150 to alleviate the difference of thermal stress between them. To explain this in detail, the upper substrate 116 has a first thermal expansion coefficient, the sealing layer 150 has a second thermal expansion coefficient relatively lower than the first thermal expansion coefficient, and the-upper dielectric layer 112 has a third thermal expansion coefficient between the first and second thermal expansion coefficients. For example, the thermal expansion coefficient of the upper substrate 116 is $80\times10^{-7}$~$95\times10^{-7}$/° C., the thermal expansion coefficient of the sealing layer 150 is $65\times10^{-7}$~$80\times10^{-7}$/° C, and the thermal expansion coefficient of the upper dielectric layer 112 is $72\times10^{-7}$~$86\times10^{-7}$/° C.

Accordingly, the upper dielectric layer 112 located between the upper substrate 116 and the sealing layer 150 disperses the thermal stress caused by the difference of thermal expansion coefficient between the upper substrate 116 and the sealing layer 150 in the course that the upper substrate 116 cools down to normal temperature after the protective film 110 is formed under the environment of 200~300° C. Since the thermal stress is dispersed by the upper dielectric layer 112, it is possible to prevent a crack from occurring in the upper substrate 116 that overlaps with the sealing layer 150 while having the upper dielectric layer 112 therebetween. Herein, the composition and content of the upper dielectric layer 112 is as follows.

TABLE 1

| | Composition | | | |
|---|---|---|---|---|
| | PbO | $B_2O_3$ | $Al_2O_3$ | $SiO_2$ |
| Content | 45~55% | 10~20% | 10~20% | 15~20% |

Figure 5:
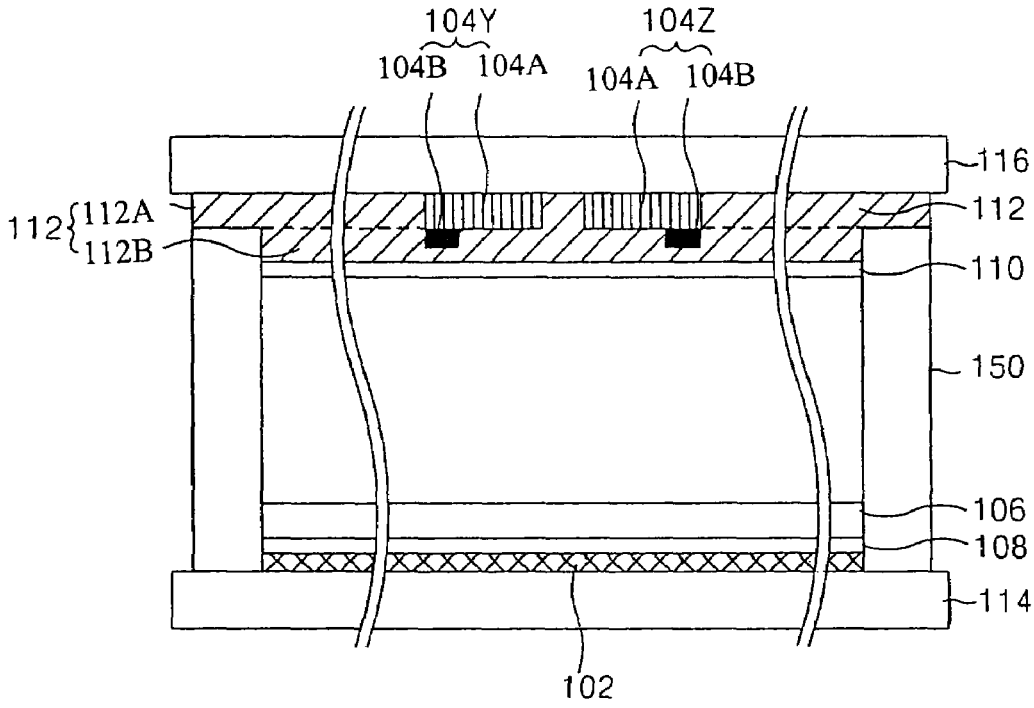
FIG. 5 is a diagram representing that an upper dielectric layer of the plasma display panel according to the first embodiment of the present invention is double-layered.

On the other hand, as shown in FIG. 5, the upper dielectric layer 112 of the PDP according to the first embodiment of the present invention can be formed to be a double layer including a first lower dielectric layer 112A and a second dielectric layer 112B, and the sealing layer 150 can be formed on the first lower dielectric layer 112A that has been formed on the substrate 116.

FIGS. 6A to 6D are sectional diagrams representing a sealing process of the PDP according to the embodiment of the present invention.

Figure 6A:
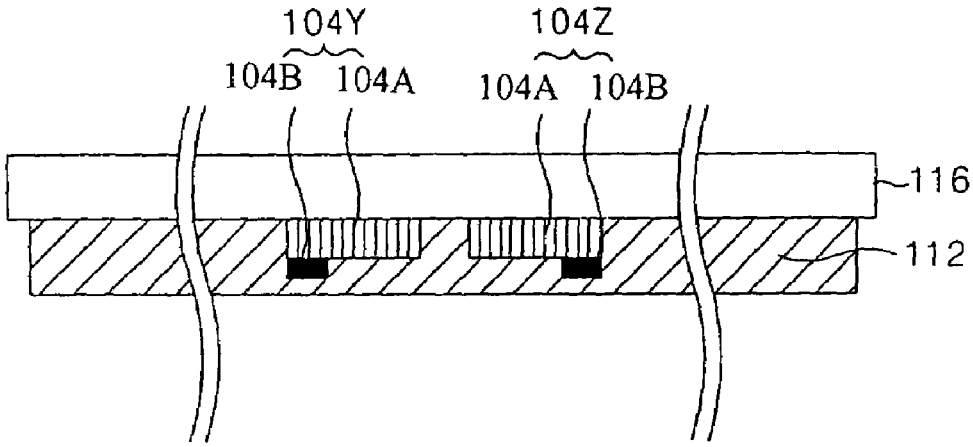
FIGS. 6A to 6D are sectional diagrams representing a sealing process of the plasma display panel according to the first embodiment of the present invention.
Figure 6B:
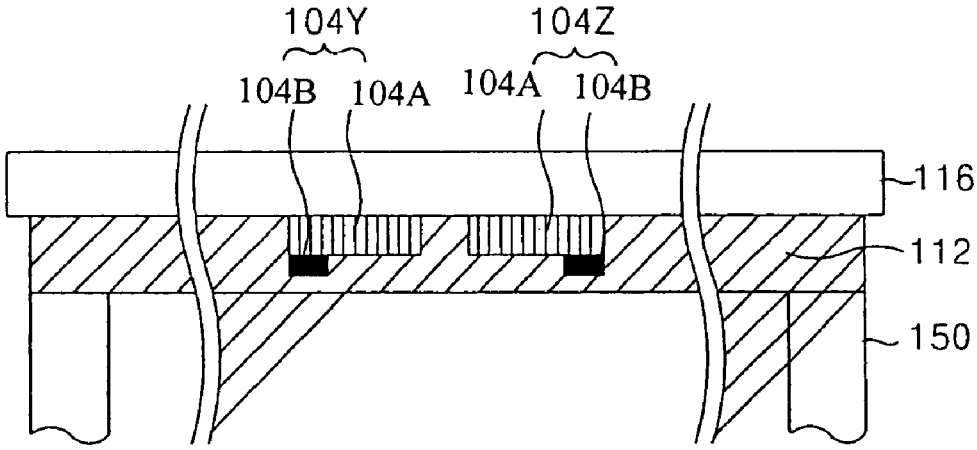

Firstly, an upper dielectric layer material is spread on the upper substrate 116 on which the sustain electrode pair 104Y, 104Z have been formed, thereby forming the upper dielectric layer 112 on the front surface of the upper substrate 116, as shown in FIG. 6A. The sealing layer 150 is formed on the upper substrate 116 where the upper dielectric layer 112 has been formed, as shown in FIG. 6B. The sealing layer 150 is formed by spreading a paste in use of screen printing or dispenser, wherein the paste is formed by mixing glass powder, solvent and binder together.

Figure 6C:
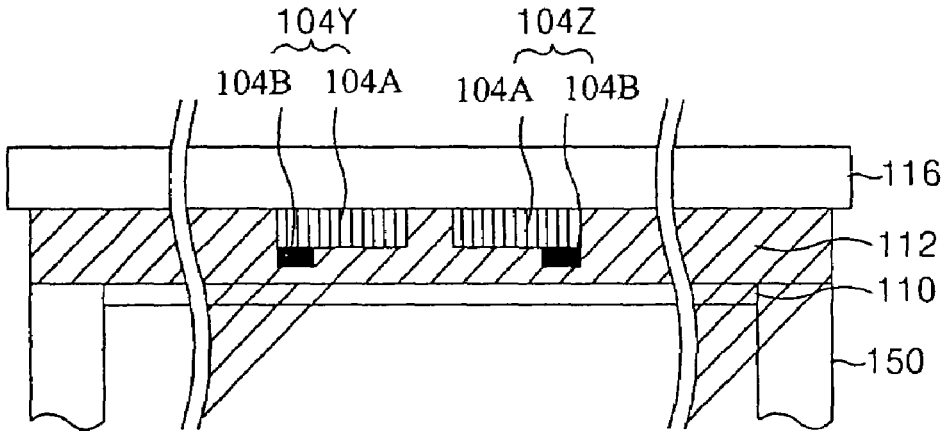

Subsequently, as shown in FIG. 6C, a protective film 110 is formed on the upper substrate 116, on which the sealing layer 150 has been formed, by using E-beam deposition or sputtering method under the environment of 200~300° C.

Figure 6D:
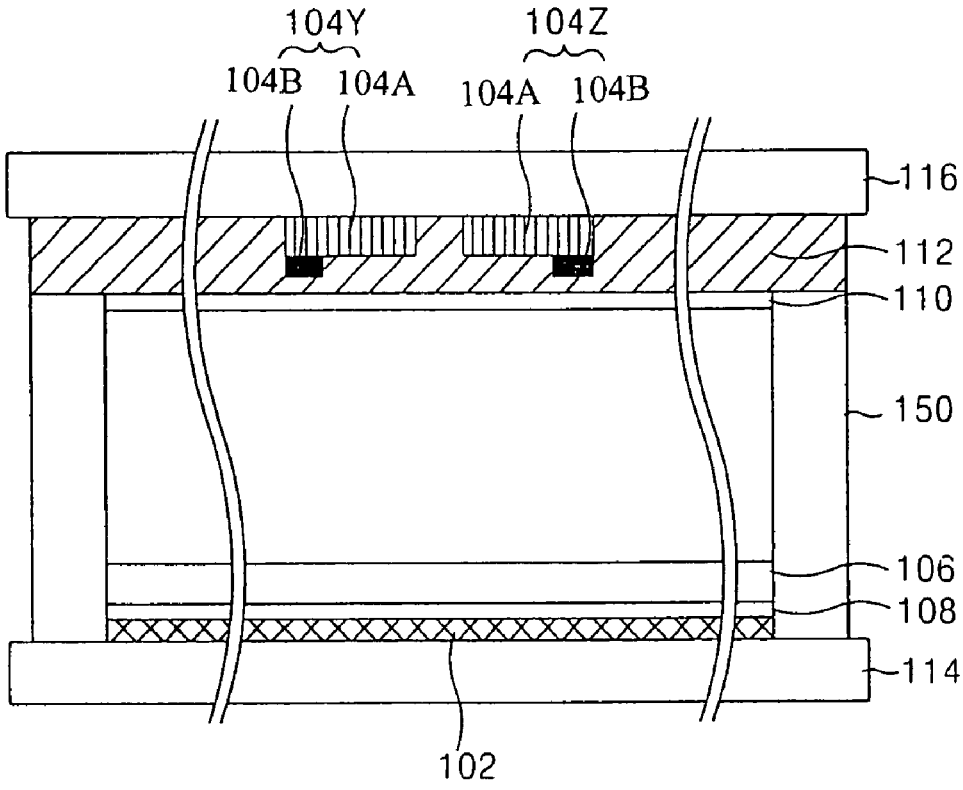

Subsequently, the upper substrate 116 where the sealing layer 150 has been formed is aligned with the lower substrate 114. The aligned upper substrate 116 and the lower substrate 114 are fired to remove a large amount of solvent and organic material which is contained within the sealing layer, thereby joining the upper/lower substrate 116, 114, as shown in FIG. 6D.

Figure 7:
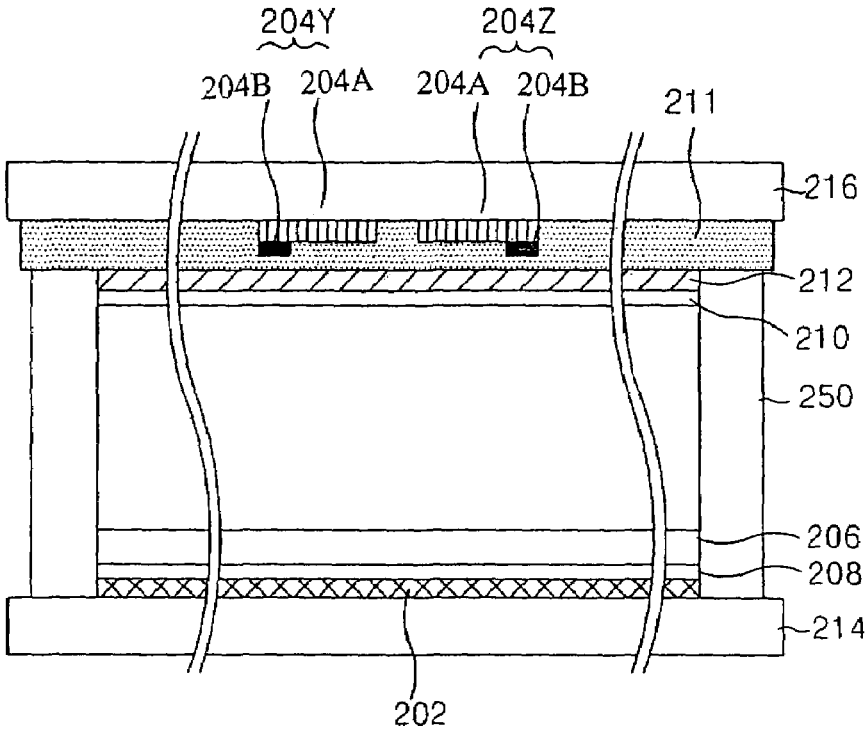
FIG. 7 is a sectional diagram representing a discharge cell structure of a plasma display panel according to a second embodiment of the present invention.

FIG. 7 is a sectional diagram representing a PDP according to a second embodiment of the present invention.

Referring to FIG. 7, the PDP according to the second embodiment of the present invention, when compared with the PDP shown in FIG. 4, has the same components except that it further includes a buffer layer 211 between the upper substrate 216 and the upper dielectric layer 212. Herein a transparent electrode 204A and a metal bus electrode 204B are formed on the upper substrate 216. A lower dielectric layer 218 and barrier ribs 208 are formed on the lower substrate 214 where address electrode 202 has been formed, and a phosphorus 206 is formed on the surface of the lower dielectric layer 218 and the barrier ribs 208. The address electrode 202 is orthogonal to the sustain electrode pair 204. The barrier ribs 208 are formed along the address electrode 202 to prevent the ultraviolet ray and visible ray generated by discharge from leaking out to adjacent discharge cells. The phosphorus 206 is excited by the vacuum ultraviolet ray generated upon plasma discharge to generate any one of red, green or blue visible ray.

The buffer layer 211 is formed to be in contact with the sealing layer 250 at the lower part of the upper dielectric layer 212 and to have its thickness of 5~50 μm on the entire surface of the upper substrate 216.

The buffer layer 211 is made of a material that has its thermal expansion coefficient between the thermal expansion coefficient of the upper substrate 216 and the thermal expansion coefficient of the sealing layer 250. For example, the thermal expansion coefficient of the upper substrate 216 is $80\times10^{-7}$~$95\times10^{-7}$/° C., the thermal expansion coefficient of the sealing layer 250 is $65\times10^{-7}$~$80\times10^{-7}$/° C., and the thermal expansion coefficient of the buffer layer 211 is $72\times10^{-7}$~$86\times10^{-7}$/° C. The material included in the buffer layer 211 is the same material as in the upper dielectric layer 216.

Accordingly, the area of the buffer layer 211 that is in contact with the sealing layer 250 disperses the thermal stress caused by the difference of thermal expansion coefficient between the upper substrate 216 and the sealing layer 250. Since the thermal stress is dispersed by the buffer layer 211, it is possible to prevent a crack from occurring in the upper substrate 216. Herein, the composition and content of the buffer layer 211 is as in table 2, and it is the same as the composition and content of the upper dielectric layer 212.

TABLE 2

| | Composition | | | |
|---|---|---|---|---|
| | PbO | $B_2O_3$ | $Al_2O_3$ | $SiO_2$ |
| Content | 45~55% | 10~20% | 10~20% | 15~25% |

Figure 8:
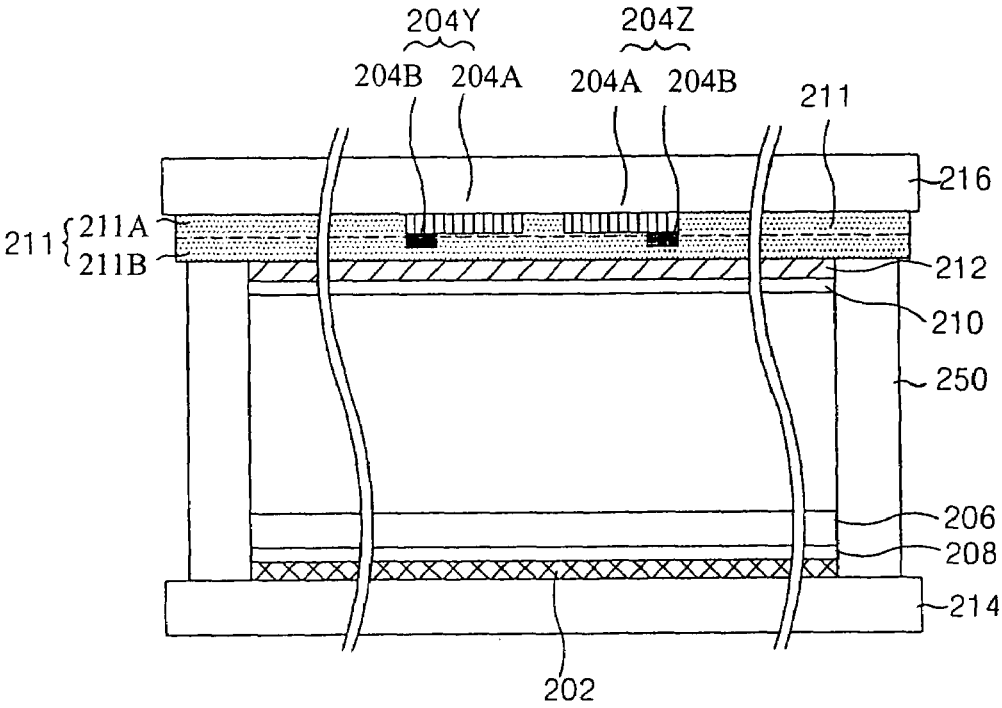
FIG. 8 is a diagram representing that a buffer layer of the plasma display panel according to the second embodiment of the present invention is double-layered.

On the other hand, as shown in FIG. 8, the buffer layer 211 of the PDP according to the second embodiment of the present invention can be formed to be a double layer of first and second buffer layers 211A, 211B, and the buffer layer 211 can be formed in the first buffer layer 211A so that it can have lower height than the buffer layer 211 of FIG. 7.

FIGS. 9A to 9D are sectional diagrams representing a sealing process of the PDP according to the embodiment of the present invention.

Figure 9A:
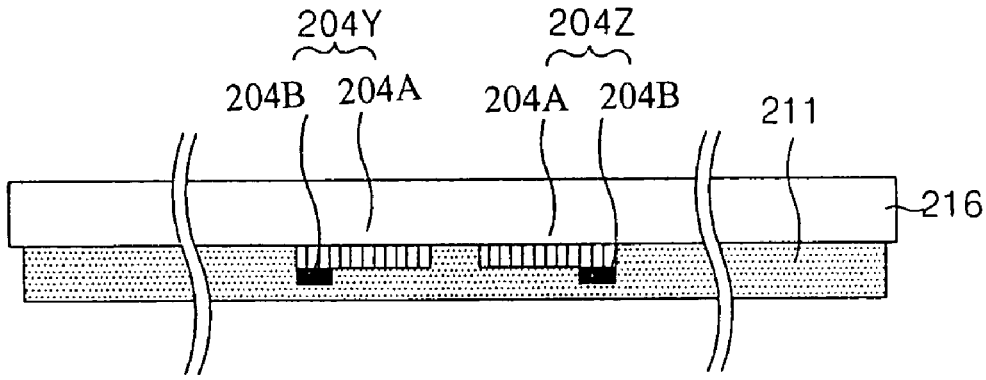
FIG. 9A to 9D are sectional diagrams representing a sealing process of the plasma display panel according to the second embodiment of the present invention.
Figure 9B:
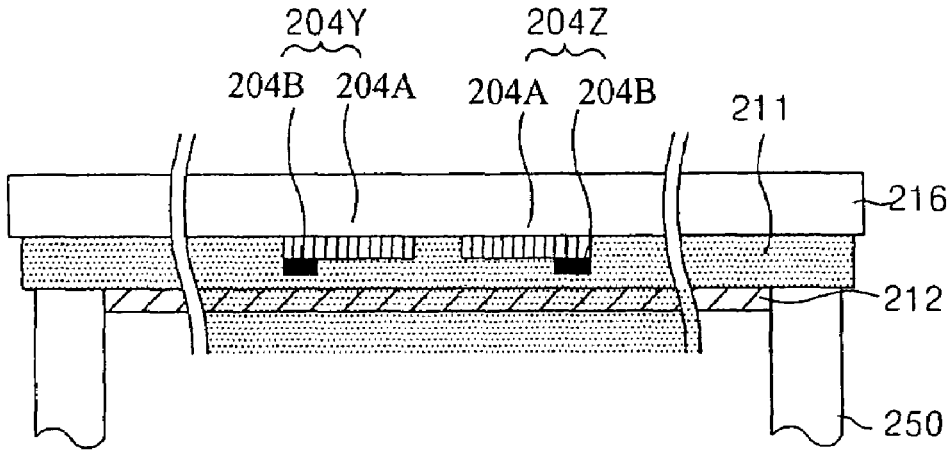

Firstly, the buffer layer 211 is formed on the front surface of the upper substrate 216 where the sustain electrode pair 204Y, 204Z have been formed, as shown in FIG. 9A. The upper dielectric layer 212 is formed in a display area on the buffer layer 211 by spreading a dielectric layer material on an area except for the sealing area of the upper substrate 216 where the buffer layer 211 has been formed. The sealing layer 250 is formed on the upper substrate 216 where the upper dielectric layer 212 has been formed, as shown in FIG. 9B. The sealing layer 250 is formed by spreading a sealing material paste in use of screen printing or dispenser, wherein the sealing material paste is formed by mixing glass powder, solvent and binder together.

Figure 9C:
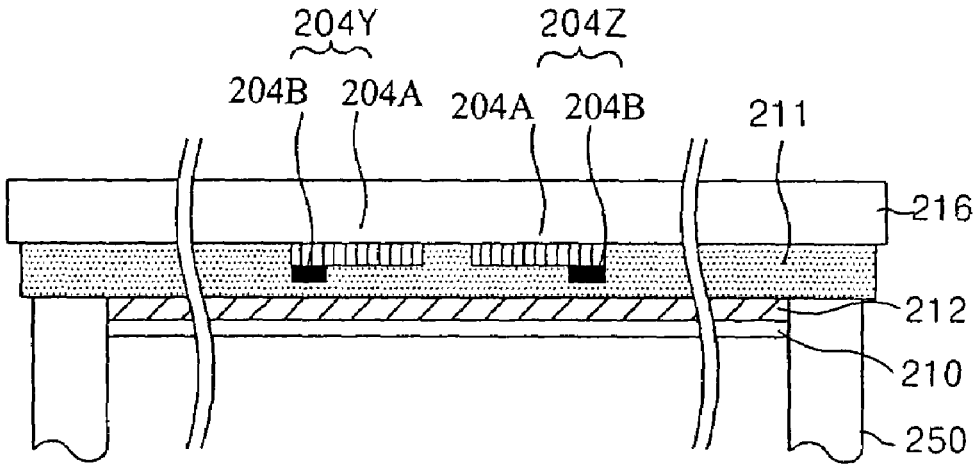

Subsequently, as shown in FIG. 9C, a protective film 210 is formed on the upper substrate 216, on which the sealing layer 250 has been formed, by using E-beam deposition or sputtering method under the environment of 200~300° C.

Figure 9D:
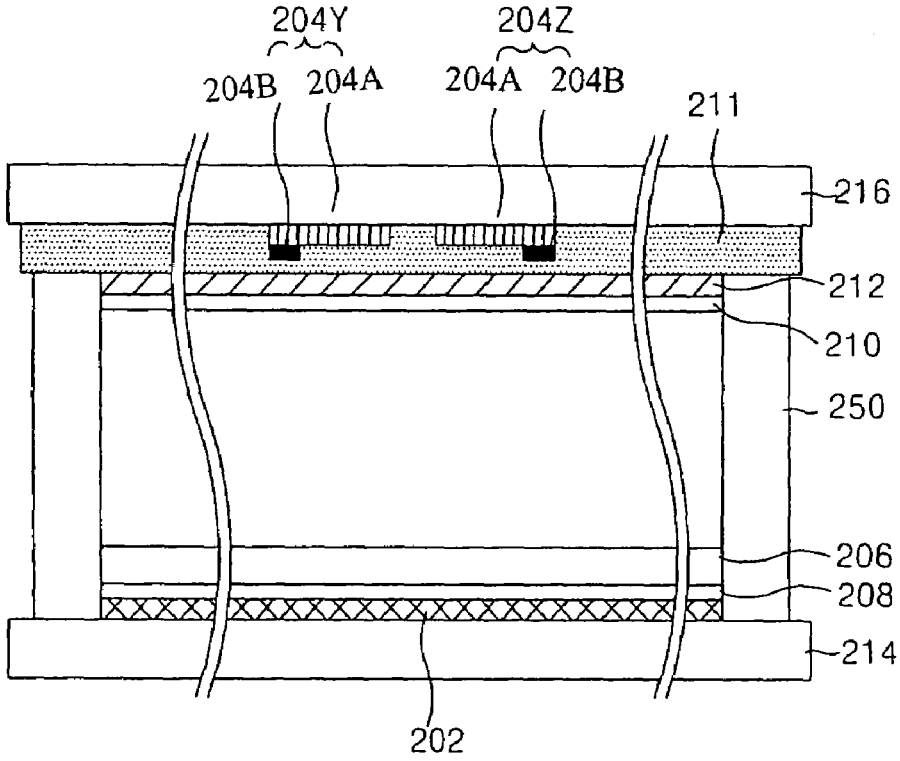

Subsequently, the upper substrate 216 where the sealing layer 250 has been formed is aligned with the lower substrate 214. The aligned upper substrate 216 and the lower substrate 214 are fired to remove a large amount of solvent and organic material which is contained within the sealing layer, thereby joining the upper/lower substrate 216, 214, as shown in FIG. 9D.

Figure 10:
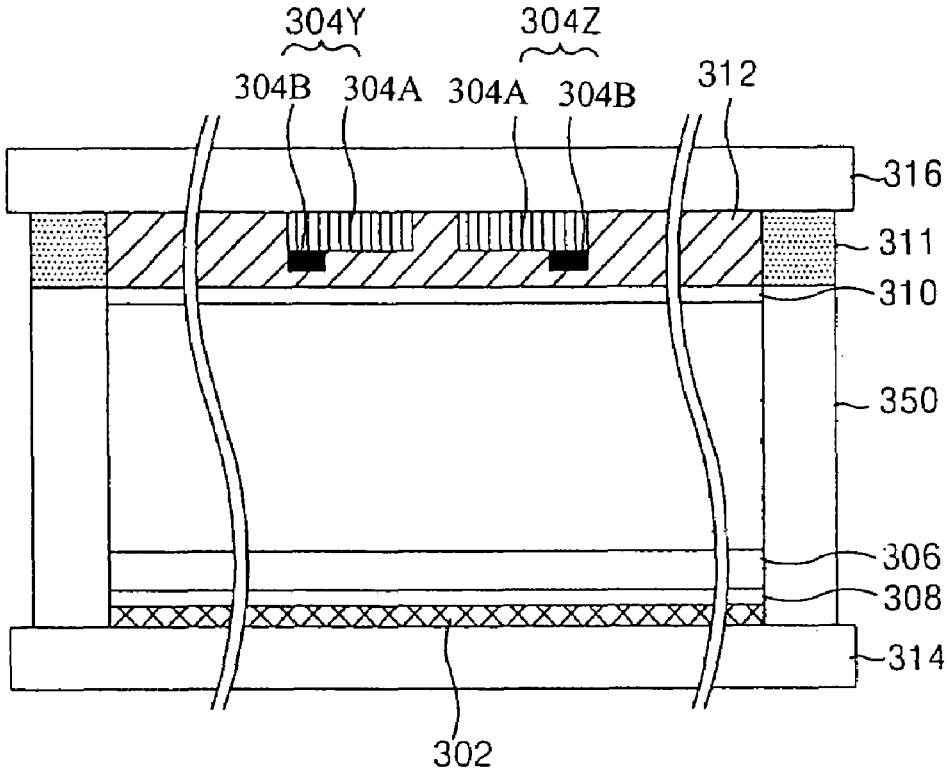
FIG. 10 is a sectional diagram representing a discharge cell structure of a plasma display panel according to a third embodiment of the present invention.

FIG. 10 is a sectional diagram representing a PDP according to a third embodiment of the present invention.

Referring to FIG. 10, the PDP according to the third embodiment of the present invention, when compared with the PDP shown in FIG. 4, has the same components except that it further includes a buffer layer 311 between the upper substrate 316 and the sealing layer 350. Herein, a transparent electrode 304A and a metal bus electrode 304B are formed on the upper substrate 316. A lower dielectric layer 318 and barrier ribs 308 are formed on the lower substrate 314 where address electrode 302 has been formed, and a phosphorus 306 is formed on the surface of the lower dielectric layer 318 and the barrier ribs 308. The address electrode 302 is orthogonal to the sustain electrode pair 304. The barrier ribs 308 are formed along the address electrode 302 to prevent the ultraviolet ray and visible ray generated by discharge from leaking out to adjacent discharge cells. The phosphorus 306 is excited by the vacuum ultraviolet ray generated upon plasma discharge to generate any one of red, green or blue visible ray.

Figure 11:
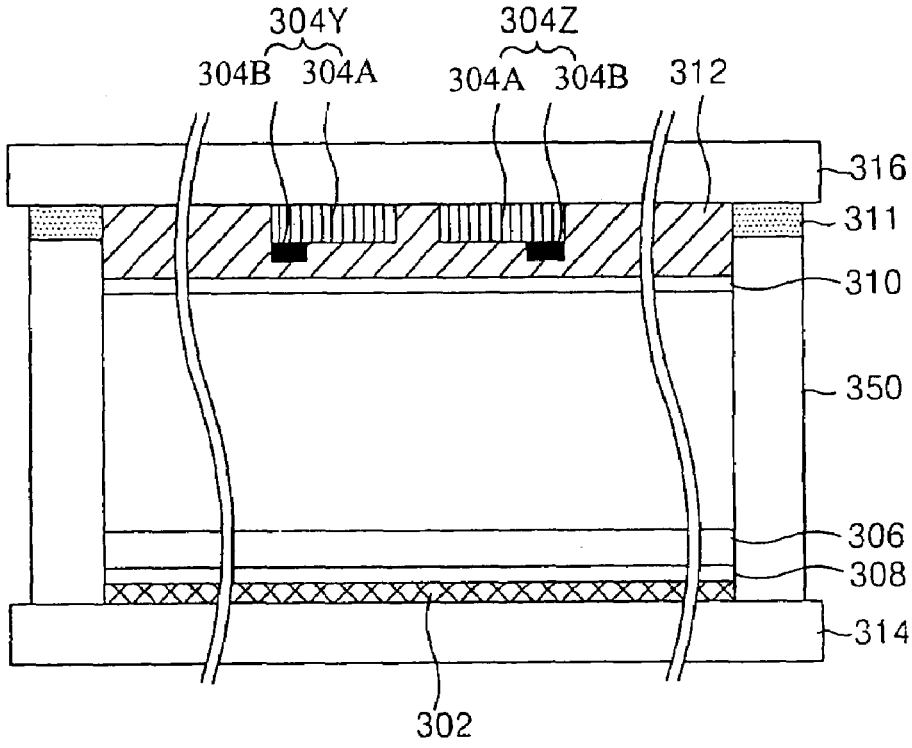
FIG. 11 is a sectional diagram representing that a buffer layer of the plasma display panel according to the third embodiment of the present invention is lower in height than an upper dielectric layer.

The buffer layer 311 is formed on the upper substrate 316 to be in contact with the sealing layer 350 and to have its thickness of 5~50 μm only at the area where it overlaps with the buffer layer 311. Herein, the buffer layer 311 might be formed to have lower height than the upper dielectric layer 311, as shown in FIG. 11.

The buffer layer 311 is made of a material that has its thermal expansion coefficient between the thermal expansion coefficient of the upper substrate 316 and the thermal expansion coefficient of the sealing layer 350. For example, the thermal expansion coefficient of the upper substrate 316 is $80\times10^{-7}$~$95\times10^{-7}$/° C., the thermal expansion coefficient of the sealing layer 350 is $65\times10^{-7}$~$80\times10^{-7}$/° C., and the thermal expansion coefficient of the buffer layer 311 is $72\times10^{-7}$~$86\times10^{-7}$/° C. The material included in the buffer layer 311 is the same material as in the upper dielectric layer 316 .

Accordingly, the area of the buffer layer 311 that is in contact with the sealing layer 350 disperses the thermal stress caused by the difference of thermal expansion coefficient between the upper substrate 316 and the sealing layer 350. Since the thermal stress is dispersed by the buffer layer 311, it is possible to prevent a crack from occurring in the upper substrate 316. Herein, the composition and content of the buffer layer 311 is as in table 3, and it is the same as the composition and content of the upper dielectric layer 312 .

TABLE 3

| | Composition | | | |
|---|---|---|---|---|
| | PbO | $B_2O_3$ | $Al_2O_3$ | $SiO_2$ |
| Content | 45~55% | 10~20% | 10~20% | 15~25% |

FIGS. 12A to 12D are sectional diagrams representing a sealing process of the PDP according to the embodiment of the present invention.

Figure 12A:
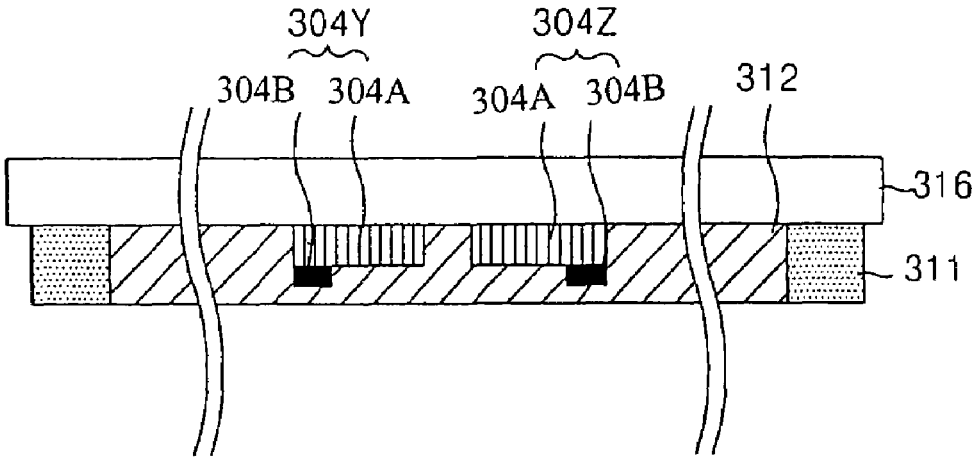
FIG. 12A to 12C are sectional diagrams representing a sealing process of the plasma display panel according to the third embodiment of the present invention.
Figure 12B:
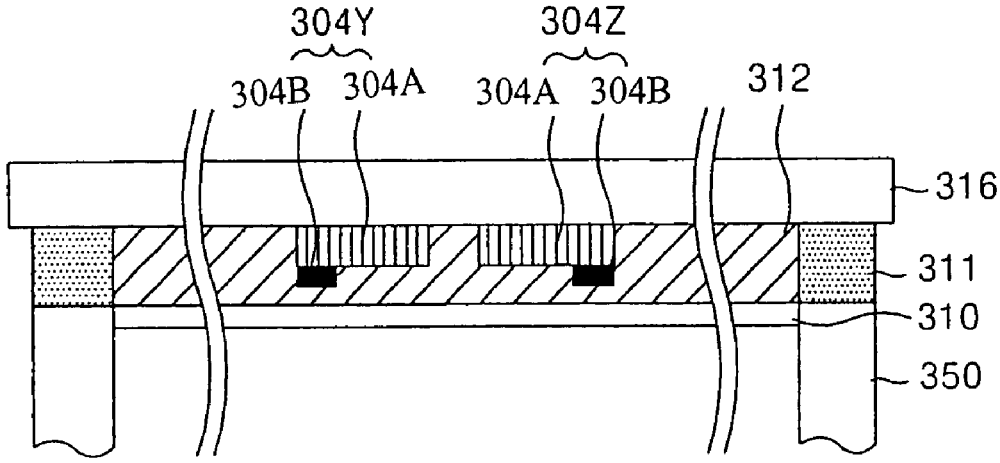

The buffer layer 311 is formed at an area, which is to be described later, that the sealing layer 350 overlaps with the upper substrate 316, as shown in FIG. 12, by spreading a buffer layer material on the upper substrate 316 where the sustain electrode pair 304Y, 304Z have been formed, as shown in FIG. 12A. Then, the upper dielectric layer 312 is formed by spreading a dielectric layer material on the upper substrate 316 except for an area where the buffer layer 311 has been formed. The sealing layer 350 is formed on the upper substrate 316 where the upper dielectric layer 312 has been formed, as shown in FIG. 12B. The sealing layer 350 is formed by spreading a paste in use of screen printing or dispenser, wherein the paste is formed by mixing glass powder, solvent and binder together.

Figure 12C:
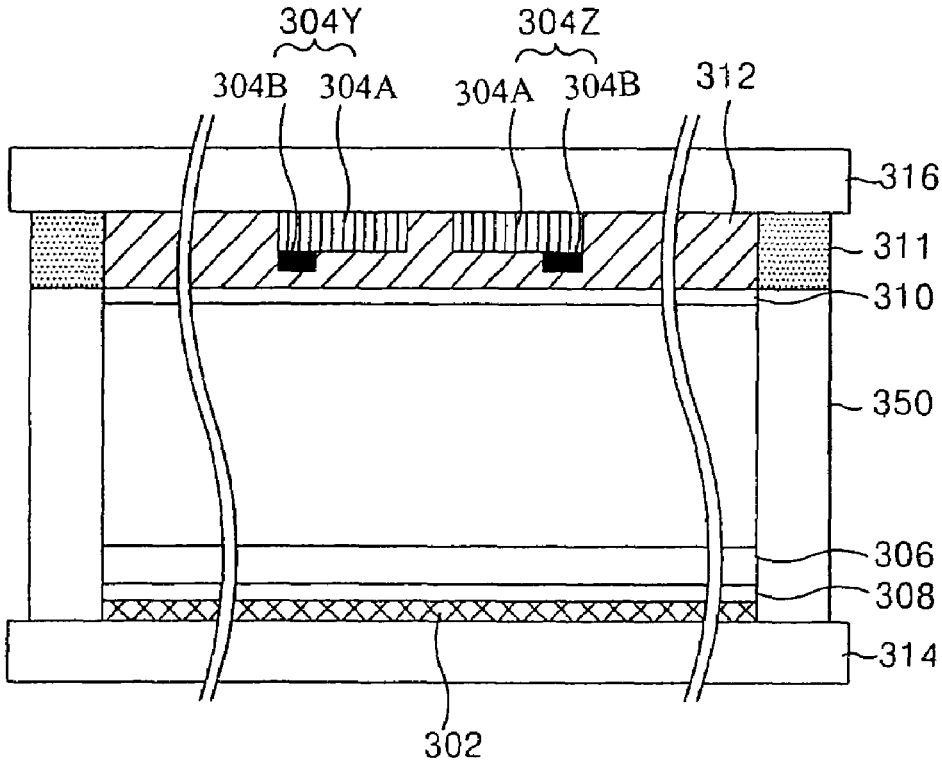

Subsequently, a protective film 310 is formed on the upper substrate 316, on which the sealing layer 350 has been formed, by using E-beam deposition or sputtering method under the environment of 200~300° C. Subsequently, the upper substrate 316 where the sealing layer 350 has been formed is aligned with the lower substrate 314. The aligned upper substrate 316 and the lower substrate 314 are fired to remove a large amount of solvent and organic material which is contained within the sealing layer, thereby joining the upper/lower substrate 316, 314, as shown in FIG. 12C.

As described above, a plasma display panel and a fabricating method thereof according to the present invention extends the dielectric layer or forms the buffer layer between the upper substrate and the sealing layer, thereby dispersing the partial thermal stress generated upon heating or cooling due to the difference of thermal expansion coefficient between the upper substrate and the sealing layer, so that the crack on the upper substrate can be prevented.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel comprising:

a first substrate;

a second substrate arranged with respect to the first substrate such that a discharge space is provided therebetween;

a first sealing layer provided between the first substrate and the second substrate;

a second sealing layer provided between the first substrate and the second substrate;

at least one of a multi-layered buffer layer or a multi-layered dielectric layer provided on the first substrate, the at least one of the multi-layered buffer layer or the multi-layered dielectric layer including a first layer provided between the first substrate and the first sealing layer and a second layer provided between the first sealing layer and the second sealing layer, the first layer provided between the first substrate and the second layer; and a protective layer on the second layer of the at least one of the multi-layered buffer layer or the multi-layered dielectric layer such that the second layer is provided between the protective layer and the first layer, wherein at least one edge portion of the protective layer contacts the first sealing layer, wherein the first sealing layer contacts the multi-layered buffer layer or the multi-layered dielectric layer, the first sealing layer does not contact the first substrate and the second sealing layer does not contact the first substrate.

2. The plasma display panel according to claim 1, wherein the at least one of the multi-layered buffer layer or the multi-layered dielectric layer has a thickness of 35 μm to 50 μm between the first substrate and the first sealing layer.

3. The plasma display panel according to claim 1, wherein the at least one of the multi-layered buffer layer or the multi-layered dielectric layer has a thermal expansion coefficient greater than or equal to $72\times10^{-7}$ mm/° C.

4. The plasma display panel according to claim 3, wherein the at least one of the multi-layered buffer layer or the multi-layered dielectric layer has a thermal expansion coefficient of approximately $72\times10^{-7}$ mm/° C. to $85\times10^{-7}$ mm/° C.

5. The plasma display panel according to claim 1, wherein the at least one of the multi-layered buffer layer or the multi-layered dielectric layer has the following composition:

PbO at a ratio of 45% to 55%, $B_2O$ at a ratio of 10% to 20%, and $SiO_2$ at a ratio of 15% to 25%.

6. The plasma display panel according to claim 1, wherein the at least one of the multi-layered buffer layer or the multi-layered dielectric layer is a double-layered buffer layer including the first layer and third layer, and a dielectric layer including the second layer is formed on the third layer such that the third layer is provided between the first layer and the dielectric layer and such that the dielectric layer is provided between the third layer and the protective layer.

7. The plasma display panel according to claim 1, further comprising:

a transparent electrode provided on the first substrate; and a metal electrode provided over the transparent electrode, wherein an edge portion of the transparent electrode and an edge portion of the metal electrode are located approximately at a same position.

8. The plasma display panel according to claim 1, wherein at least one edge portion of the first substrate and an edge portion of the multi-layered dielectric layer or the multi-layered buffer layer are located at different positions.

9. The plasma display panel according to claim 1, wherein the first sealing layer contacts the second substrate and the second sealing layer contacts the second substrate.

10. The plasma display panel according to claim 1, wherein the first sealing layer contacts a lower surface of the first layer of the at least one of the multi-layered buffer layer or the multi-layered dielectric layer.

11. The plasma display panel according to claim 1, wherein the first layer of the multi-layered buffer layer or the multi-layered dielectric layer substantially contacts the first substrate.

12. The plasma display panel according to claim 7, wherein the transparent electrode contacts the first substrate and the multi-layered dielectric layer contacts the first substrate.

13. A plasma display panel comprising:

a first substrate;

a second substrate arranged with respect to the first substrate such that a discharge space is provided therebetween;

a first sealing layer provided between the first substrate and the second substrate;

a second sealing layer provided between the first substrate and the second substrate;

at least one of a multi-layered buffer layer or a multi-layered dielectric layer provided on the first substrate, the at least one of multi-layered buffer layer or the multi-layered dielectric later including a first layer provided between the first substrate and the first sealing layer and a second layer provided between the first sealing layer and the second sealing layer; and an edge portion of the multi-layered dielectric layer or the multi-layered buffer layer and an edge portion of the first sealing layer are located approximately at a same position;

wherein the first sealing layer contacts the multi-layered buffer layer or the multi-layered dielectric layer, the first sealing layer does not contact the first substrate and the second sealing layer does not contact the first substrate.

14. The plasma display panel according to claim 13, further comprising:

a protective layer formed on the at least one of the multi-layered buffer layer or the multi-layered dielectric layer, wherein at least one edge portion of the protective layer contacts the first sealing layer.

15. The plasma display panel according to claim 13, wherein the multi-layered buffer layer or the multi-layered dielectric layer has a thickness of 35 μm to 50 μm between the first substrate and the first sealing layer.

16. The plasma display panel according to claim 13, wherein the at least one of the multi-layered buffer layer or the multi-layered dielectric layer has a thermal expansion coefficient greater than or equal to $72\times10^{-7}$ mm/° C.

17. The plasma display panel according to claim 16, wherein the at least one of the multi-layered buffer layer or the multi-layered dielectric layer has a thermal expansion coefficient of approximately $72\times10^{31\ 7}$ mm/° C. to $85\times10^{-7}$ mm/° C.

18. The plasma display panel according to claim 13, wherein the at least one of the multi-layered buffer layer or the multi-layered dielectric layer has the following composition:

PbO at a ratio of 45% to 55%, $B_2O$ at a ratio of 10% to 20%, and $SiO_2$ at a ratio of 15% to 25%.

19. The plasma display panel according to claim 13, wherein the at least one of the multi-layered buffer layer or the multi-layered dielectric layer is a double-layered buffer layer including the first layer and a third layer, and a dielectric layer including the second layer is formed on the third layer such that the third layer is provided between the first layer and the dielectric layer and such that the dielectric layer is provided between the third layer and the protective layer.

20. The plasma display panel according to claim 13, further comprising:

a transparent electrode provided on the first substrate; and a metal electrode provided over the transparent electrode, wherein an edge portion of the transparent electrode and an edge portion of the metal electrode are located approximately at a same position.

21. The plasma display panel according to claim 13, wherein at least one edge portion of the first substrate and an edge portion of the multi-layered dielectric layer or the multi-layered buffer layer are located at different positions.

22. The plasma display panel according to claim 13, wherein the first sealing layer contacts the second substrate and the second layer contacts the second substrate.

23. A plasma display panel comprising:

a first substrate and a second substrate having a discharge space provided therebetween;

a first sealing layer and a second sealing layer both provided between the first substrate and the second substrate;

at least one of a multi-layered buffer layer or a multi-layered dielectric layer on the first substrate, the at least one of the multi-layered buffer layer or the multi-layered dielectric layer including a first layer between the first substrate and the first sealing layer and a second layer between the first layer and the second sealing layer; and a protective layer on the second layer of the at least one of the multi-layered buffer layer or the multi-layered dielectric layer, the first sealing layer extending in a first direction from a first end adjacent the at least one of the multi-layered buffer layer or the multi-layered dielectric layer to a second end adjacent the second substrate, the protective layer extending in a second direction from a first end adjacent a side surface of the first sealing layer to a side surface of the second sealing layer, wherein the first sealing layer and the second sealing layer contact the multi-layered buffer layer or the multi-layered dielectric layer, and the first and second sealing layers do not contact the first substrate.

24. The plasma display panel according to claim 23, wherein the at least one of the multi-layered buffer layer or the multi-layered dielectric layer is a double-layered buffer layer including the first layer, and a single dielectric layer including the second layer is formed on the double-layered buffer layer such that the double-layered buffer layer is provided between the first substrate and the single dielectric layer and such that the single dielectric layer is provided between the doubled-layered buffer layer and the protective layer.

25. A plasma display panel comprising:

a first substrate and a second substrate having a discharge space provided therebetween;

a first sealing layer and a second sealing layer both provided between the first substrate and the second substrate;

a multi-layered buffer layer on the first substrate, the multi-layered buffer layer provided between the first substrate and the first sealing layer and between the first substrate and the second sealing layer;

a dielectric layer on the multi-layered buffer layer and between the first sealing layer and the second sealing layer; and a protective layer on the dielectric layer such that the dielectric layer is between the multi-layered buffer layer and the dielectric layer, the first sealing layer extending in a first direction from a first end adjacent the multi-layered buffer layer to a second end adjacent the second substrate, the protective layer extending in a second direction from a first end adjacent a side surface of the first sealing layer to a side surface of the second sealing layer, and the dielectric layer extending in the second direction from a first end adjacent the side surface of the first sealing layer to the side surface of the second sealing layer, wherein the first sealing layer and the second sealing layer contact the multi-layered buffer layer, and the first and second sealing layers do not contact the first substrate.

* * * * *